US007857478B1

(12) United States Patent
Keller

(10) Patent No.: US 7,857,478 B1
(45) Date of Patent: Dec. 28, 2010

(54) WEARABLE SAFETY LIGHT APPARATUS

(76) Inventor: Marvin Keller, 10025 Hemet Dr., Las Vegas, NV (US) 89134

( * ) Notice: Subject to any disclaimer, the term of this patent is extended or adjusted under 35 U.S.C. 154(b) by 147 days.

(21) Appl. No.: 12/204,900

(22) Filed: Sep. 5, 2008

(51) Int. Cl.
*F21V 21/08* (2006.01)

(52) U.S. Cl. ..... 362/103; 362/108; 362/200

(58) Field of Classification Search ..... 362/103, 362/108, 200, 190
See application file for complete search history.

(56) References Cited

U.S. PATENT DOCUMENTS

| | | | | |
|---|---|---|---|---|
| 1,923,962 | A | 8/1933 | Worley | |
| 5,245,516 | A | 9/1993 | de Haas et al. | |
| D361,143 | S | 8/1995 | Helvey | |
| D362,920 | S | 10/1995 | Schwartz | |
| 5,905,441 | A * | 5/1999 | Klee et al. | 340/815.4 |
| 6,056,412 | A | 5/2000 | Atlee et al. | |
| 6,715,897 | B2 * | 4/2004 | Rowe et al. | 362/103 |
| 6,877,875 | B2 * | 4/2005 | Yu et al. | 362/105 |
| 7,192,152 | B1 | 3/2007 | Hesse | |
| 7,293,900 | B1 * | 11/2007 | Lee | 362/476 |
| 7,513,660 | B2 * | 4/2009 | Spartano et al. | 362/373 |
| 2006/0076376 | A1 | 4/2006 | Kemery et al. | |

* cited by examiner

*Primary Examiner*—Ali Alavi

(57) ABSTRACT

A wearable safety light apparatus includes a housing that includes a rear wall, a front wall and a perimeter wall extending between the front and rear walls. A light emitter is mounted in the housing and extends outwardly of the front wall. At least one battery is mounted within the housing and is electrically coupled to the light emitter to supply power to the light emitter. At least one lens is attached to the front wall and covering the light emitter. A strap is removably attached to the housing to removably attach the housing to a person.

14 Claims, 6 Drawing Sheets

WEARABLE SAFETY LIGHT APPARATUS

BACKGROUND OF THE INVENTION

Field of the Invention

The present invention relates to wearable safety light devices and more particularly pertains to a new wearable safety light device for illuminating a person to prevent collisions while exercising in the vicinity of motor vehicles.

SUMMARY OF THE INVENTION

The present invention meets the needs presented above by generally comprising a housing that includes a rear wall, a front wall and a perimeter wall extending between the front and rear walls. A light emitter is mounted in the housing and extends outwardly of the front wall. At least one battery is mounted within the housing and is electrically coupled to the light emitter to supply power to the light emitter. At least one lens is attached to the front wall and covering the light emitter. A strap is removably attached to the housing to removably attach the housing to a person.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
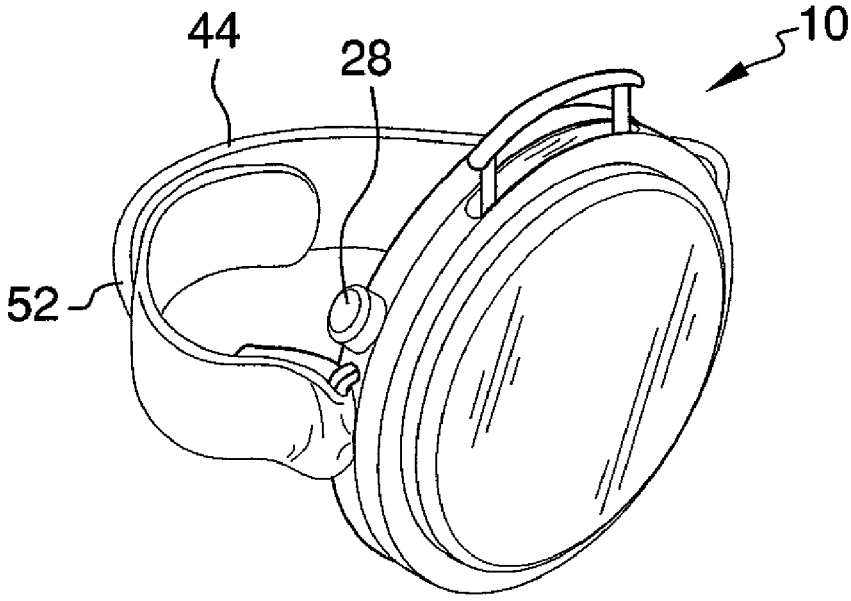
FIG. 1 is a front perspective view of a wearable safety light apparatus according to the present invention.
Figure 1A:
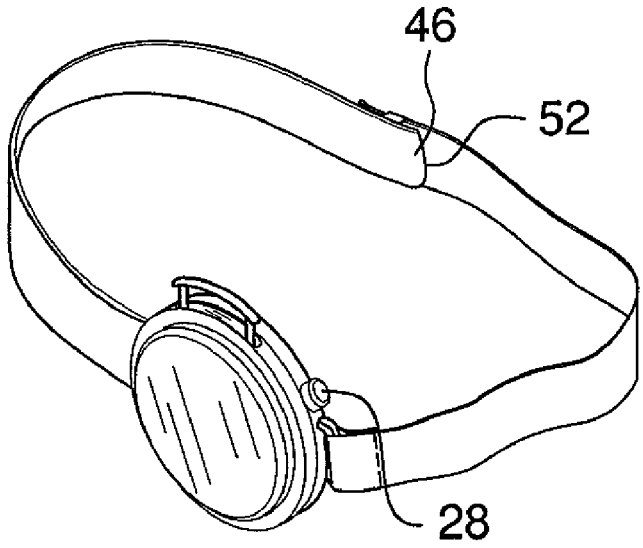
FIG. 1A is a front perspective view of the present invention showing a second strap thereof.
Figure 2:
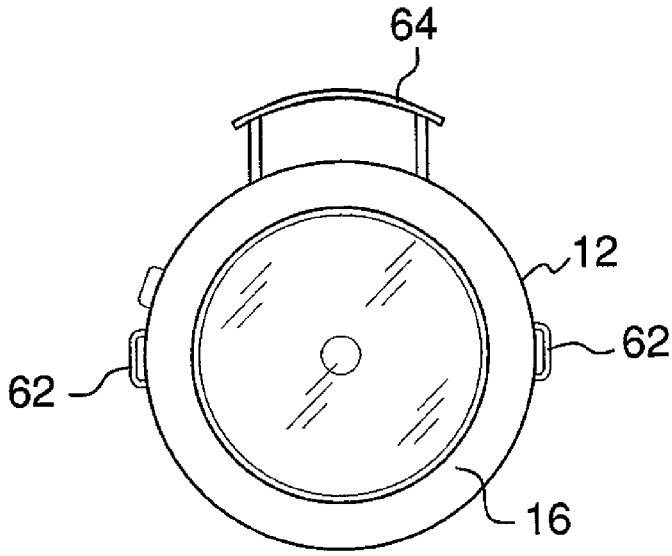
FIG. 2 is a front view of the present invention.
Figure 3:
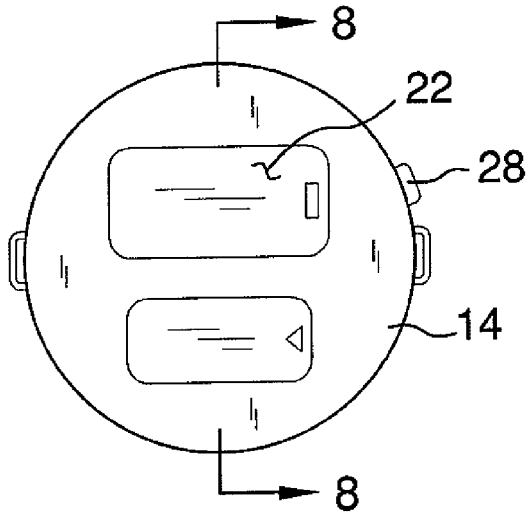
FIG. 3 is a rear view of the present invention.
Figure 5:
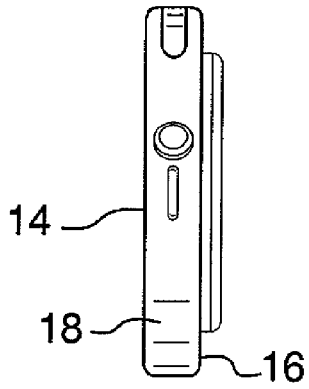
FIG. 5 is a right side view of the present invention.
Figure 4:
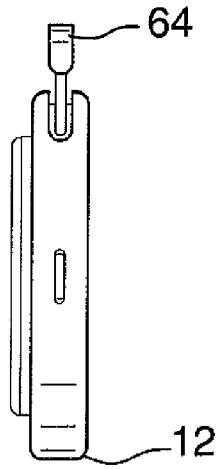
FIG. 4 is a left side view of the present invention.
Figure 6:
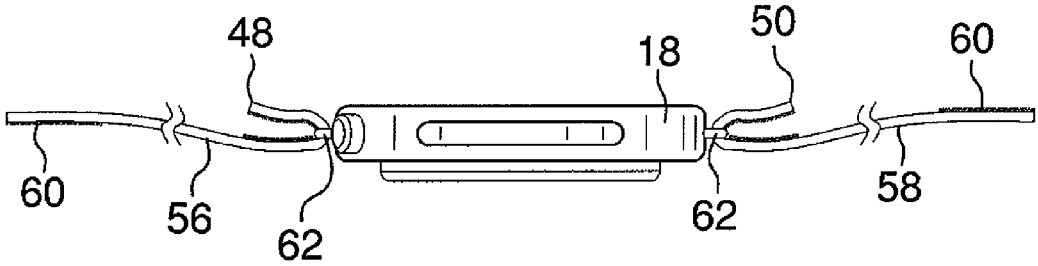
FIG. 6 is a top view of the present invention.
Figure 7:
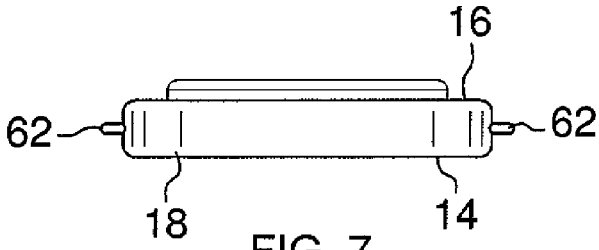
FIG. 7 is a bottom view of the present invention.
Figure 8:
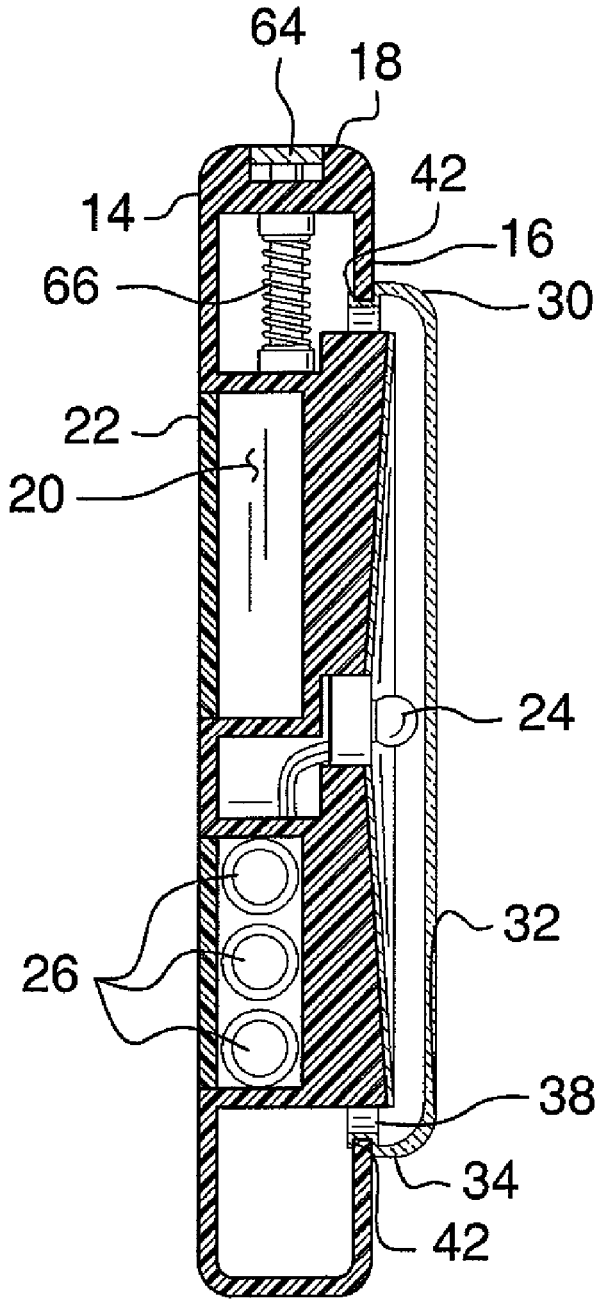
FIG. 8 is a cross-sectional view taken along line 8-8 of FIG. 3 of the present invention.

With reference now to the drawings, and in particular to FIGS. 1 through 11 thereof, a new wearable safety light device embodying the principles and concepts of the present invention and generally designated by the reference numeral 10 will be described.

As best illustrated in FIGS. 1 through 11, the wearable safety light apparatus 10 generally comprises a housing 12 that includes a rear wall 14, a front wall 16 and a perimeter wall 18 extending between the front 16 and rear walls 14. The rear wall 14 has a compartment 20 therein. A compartment door 22 is removably positioned on the rear wall 14 to close the compartment 20. The rear wall 14 has a length and width each less than 5 inches and may have circular shape having a diameter less than 5 inches.

A light emitter 24 is mounted in the housing 12 and extends outwardly of the front wall 16. The light emitter 24 comprises a light emitting diode. At least one battery 26 is mounted within the housing 12 and is electrically coupled to the light emitter 24 to supply power to the light emitter 24. The rear wall 14 has a battery door 28 therein to access the at least one battery 26.

A plurality of lenses 30 is provided. One of the lenses 30 is removably attached to the front wall 16 of the housing 12 and covers the light emitter 24. Each of the lenses 30 includes an outer wall 32 and a peripheral wall 34 that is attached to and extends rearward of the outer wall 32. Each of the peripheral walls 34 of the lenses 30 has a free edge 36. The free edge 36 of one of the lenses 30 is removably extended into a notch 38 in the front wall 16 to allow selective attachment of different ones of the lenses 30 to the housing 12. The free edges 36 each include a lip 40 engageable with a shoulder 42 formed in the notch 38. Each of the lenses 30 has a different color.

An actuator 28 is mounted on the housing 12 and is electrically coupled to the at least one battery 26 to allow the light emitter 24 to be selectively turned on or off. The actuator 28 comprises a three way switch including a first setting cutting electrical power to the light emitter 24, a second setting allowing continuous power to the light emitter 24, and a third setting allowing intermittent power to the light emitter 24 to cause the light emitter 24 to turn on and off repeatedly in a blinking fashion. This will allow the user to select the type of light emission desired.

Figure 9:
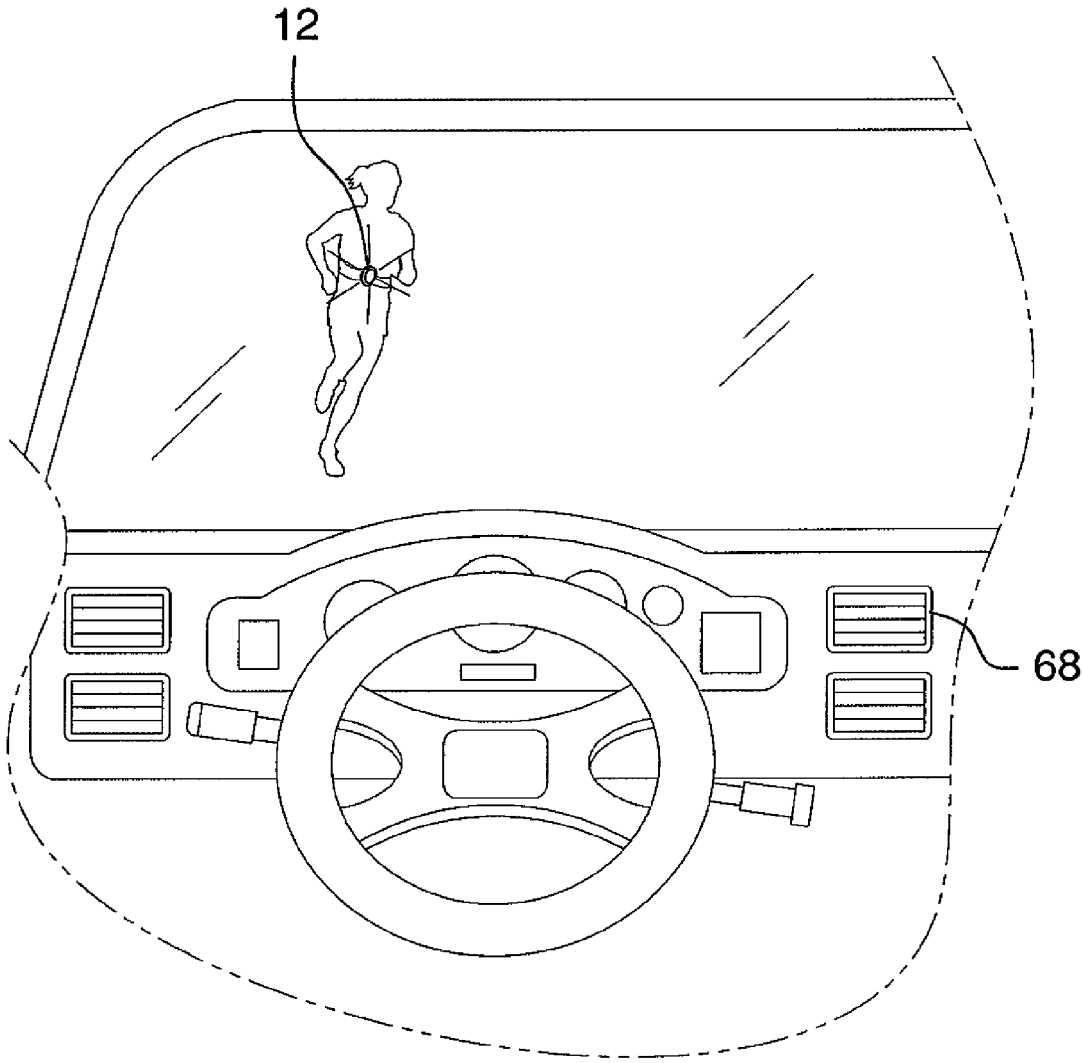
FIG. 9 is a front in-use view of the present invention.
Figure 11:
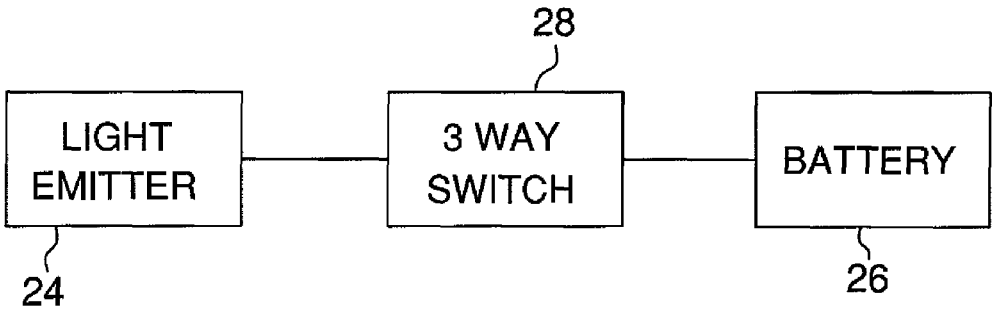
FIG. 11 is a schematic view of the present invention.
Figure 10:
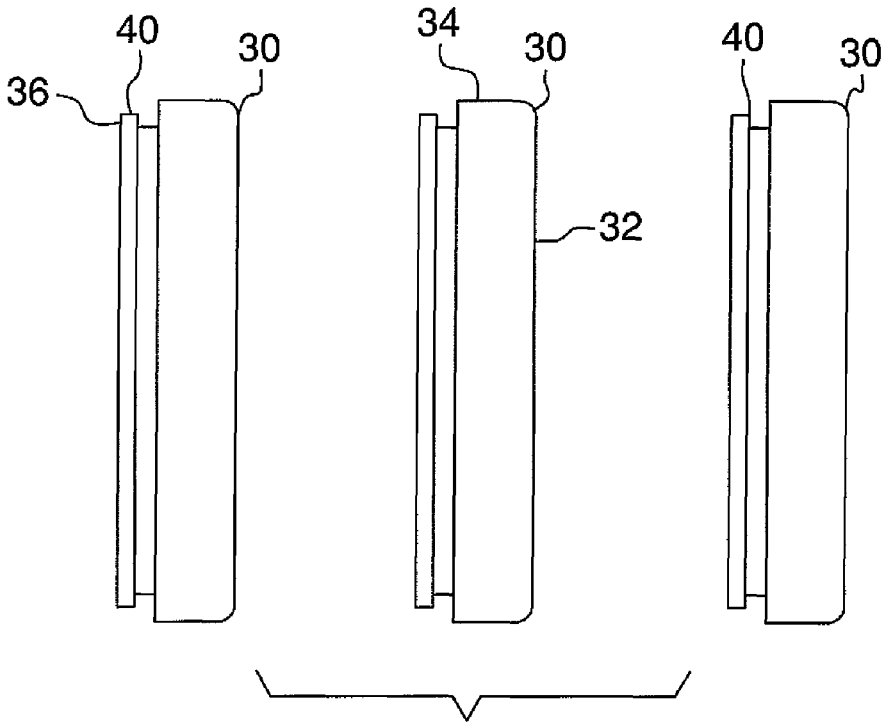
FIG. 10 is a side view of a plurality of lenses of the present invention.

A first strap 44 and a second strap 46 are provided. The second strap 46 has a longer length than the first strap 44. Each of the first 44 and second 46 straps includes a first end 48 and a second end 50. The first 44 and second 50 straps also each have a break 52 therein to define a first section 56 and a second section 58 of the first 44 and second 46 straps. Couplers 60 releasably couple together associated ones of the first 56 and second 58 sections. The couplers 60 may include hook and loop couplers. The first strap 44 has a length less than 12 inches while the second strap 46 has a length greater than 24 inches. The first strap 44 allows the housing 12 to be worn on a wrist while the second strap 46 is used to attach the housing 12 to a person's torso as is shown in FIG. 9.

A pair of connection members 62 is attached to the housing 12. Each of the first 48 and second 50 ends of one of the first 44 and second 46 straps is removably coupled to one of the connection members 62. This may again be accomplished with hook and loop fasteners attached to the straps 46 adjacent to the first 48 and second 50 ends. An unused one of the first 44 or second 46 straps is positionable in the compartment 20.

A handle 64 is attached to the housing 12. The handle 64 is retractable into the housing 12. The handle 64 allows the housing 12 to be carried, such as when a person is walking and may be retracted into the housing 12 to prevent it from interfering with a person when the person is wearing the housing 12. A biasing member 66 is mounted on the handle 64 and biases the handle 64 in a retracted position.

In use, the housing 12 is attached to the person by one of the ways shown above and is then turned on while the person is walking, running, biking or the like to ensure that the person is more easily viewable by passing vehicles 68.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A safety light apparatus comprising:

a housing including a rear wall, a front wall and a perimeter wall extending between said front and rear walls;

a light emitter being mounted in said housing and extending outwardly of said front wall;

at least one battery being mounted within said housing and being electrically coupled to said light emitter to supply power to said light emitter;

at least one lens being attached to said front wall and covering said light emitter;

a strap being removably attached to said housing; and said rear wall has a compartment therein, a compartment door being removably positioned on said rear wall to close said compartment, said strap being removably positionable in said compartment when said strap is removed from said housing.

2. The apparatus according to claim 1, further including an actuator being mounted on said housing and being electrically coupled to said at least one battery to allow said light emitter to be selectively turned on or off, said actuator comprising a three way switch including a first setting cutting electrical power to said light emitter, a second setting allowing continuous power to said light emitter, and a third setting allowing intermittent power to said light emitter to cause said light emitter to turn on and off repeatedly in a blinking fashion.

3. The apparatus according to claim 1, wherein said strap defines a first strap, said apparatus including a second strap having a greater length than said first strap.

4. The apparatus according to claim 1, wherein said at least one lens includes a plurality of lenses being removably couplable to said housing to allow selective mounting of one of said lenses to said housing, each of said lenses having a different color with respect to each other.

5. The apparatus according to claim 4, wherein each of said lenses includes an outer wall and a peripheral wall being attached to and extending rearward of said outer wall, each of said peripheral walls having a free edge, said free edge of one of said lenses being removably extended into a notch in said front wall to allow selective attachment of different ones of said lenses to said housing, each of said lenses having a different color.

6. The apparatus according to claim 1, wherein said strap has a first end and a second end, said strap having a break therein to define a first section and a second section of said strap, a coupler releasably coupling together said first and second sections, a pair of connection members being attached to said housing, each of said first and second ends being removably coupled to one of said connection members.

7. The apparatus according to claim 6, further including a handle being attached to said housing, said handle being retractable into said housing.

8. A safety light apparatus comprising:

a housing including a rear wall, a front wall and a perimeter wall extending between said front and rear walls, said rear wall having a compartment therein, a compartment door being removably positioned on said rear wall to close said compartment, said rear wall having a length and width each less than 5 inches;

a light emitter being mounted in said housing and extending outwardly of said front wall, said light emitter comprising a light emitting diode;

at least one battery being mounted within said housing and being electrically coupled to said light emitter to supply power to said light emitter, said rear wall having a battery door therein to access said at least one battery;

a plurality of lenses, one of said lenses being removably attached to said front wall of said housing and covering said light emitter, each of said lenses including an outer wall and a peripheral wall being attached to and extending rearward of said outer wall, each of said peripheral walls having a free edge, said free edge of one of said lenses being removably extended into a notch in said front wall to allow selective attachment of different ones of said lenses to said housing, each of said lenses having a different color;

an actuator being mounted on said housing and being electrically coupled to said at least one battery to allow said light emitter to be selectively turned on or off, said actuator comprising a three way switch including a first setting cutting electrical power to said light emitter, a second setting allowing continuous power to said light emitter, and a third setting allowing intermittent power to said light emitter to cause said light emitter to turn on and off repeatedly in a blinking fashion;

a first strap and a second strap, said second strap having a longer length than said first strap, each of said first and second straps including a first end and a second end, said first and second straps each having a break therein to define a first section and a second section of said first and second straps, couplers releasably coupling together associated ones of said first and second sections;

a pair of connection members being attached to said housing, each of said first and second ends of one of said first and second straps being removably coupled to one of said connection members, wherein an unused one of said first or second straps is positionable in said compartment; and a handle being attached to said housing, said handle being retractable into said housing.

9. A safety light apparatus comprising:

a housing including a rear wall, a front wall and a perimeter wall extending between said front and rear walls;

a light emitter being mounted in said housing and extending outwardly of said front wall;

at least one battery being mounted within said housing and being electrically coupled to said light emitter to supply power to said light emitter;

at least one lens being attached to said front wall and covering said light emitter; and a strap being removably attached to said housing, said strap having a first end and a second end, said strap having a break therein to define a first section and a second section of said strap, a coupler releasably coupling together said first and second sections, a pair of connection members being attached to said housing, each of said first and second ends being removably coupled to one of said connection members.

10. The apparatus according to claim 9, further including an actuator being mounted on said housing and being electrically coupled to said at least one battery to allow said light emitter to be selectively turned on or off, said actuator comprising a three way switch including a first setting cutting electrical power to said light emitter, a second setting allowing continuous power to said light emitter, and a third setting allowing intermittent power to said light emitter to cause said light emitter to turn on and off repeatedly in a blinking fashion.

11. The apparatus according to claim 9, wherein said strap defines a first strap, said apparatus including a second strap having a greater length than said first strap.

12. The apparatus according to claim 9, wherein said at least one lens includes a plurality of lenses being removably couplable to said housing to allow selective mounting of one of said lenses to said housing, each of said lenses having a different color with respect to each other.

13. The apparatus according to claim 12, wherein each of said lenses includes an outer wall and a peripheral wall being attached to and extending rearward of said outer wall, each of said peripheral walls having a free edge, said free edge of one of said lenses being removably extended into a notch in said front wall to allow selective attachment of different ones of said lenses to said housing, each of said lenses having a different color.

14. The apparatus according to claim 9, further including a handle being attached to said housing, said handle being retractable into said housing.

* * * * *